United States Patent [19]

Beavers et al.

[11] Patent Number: 4,611,446

[45] Date of Patent: Sep. 16, 1986

[54] CABLE ANCHORING DEVICE

[76] Inventors: Allan E. Beavers, 7961 S. Kendall Blvd., Littleton, Colo. 80123; Robert A. Fulcher, 2339 S. Balsam St., Lakewood, Colo. 80227

[21] Appl. No.: 813,404

[22] Filed: Dec. 26, 1985

[51] Int. Cl.[4] ..... E02D 5/80

[52] U.S. Cl. ..... 52/163; 52/166; 405/259

[58] Field of Search ..... 52/155, 163, 166, 162; 405/259

[56] References Cited

U.S. PATENT DOCUMENTS

| | | | |
|---|---|---|---|
| 891,171 | 6/1908 | Hobbs | 52/162 |
| 1,014,806 | 1/1912 | Burns et al. | 52/163 |
| 1,135,013 | 4/1915 | Haag | 405/259 |
| 1,178,282 | 4/1916 | Wilcox | 52/163 |
| 1,244,133 | 10/1917 | Saunders | 52/163 |
| 1,245,176 | 11/1917 | Beard | 52/163 |
| 3,969,854 | 7/1974 | Deike | 52/163 |
| 4,044,513 | 8/1977 | Deike | 52/163 |
| 4,096,673 | 6/1978 | Deike | 52/163 |

*Primary Examiner*—James L. Ridgill, Jr.
*Attorney, Agent, or Firm*—Edwin L. Spangler, Jr.

[57] ABSTRACT

This invention relates to a cable anchoring device in the form of a stamped metal blade-like part having a generally straight lower section and a slightly curved upper section terminating at its upper end in a point. The curved section of the blade contains an elongate tool-receiving aperture, the lower end of which is shaped to accept a slotted driving tool while its upper end engages the shank of the tool and maintains the latter in substantial axial alignment with the straight section. An integrally-formed dimple with a cable-receiving hole in it is located on the outside of the blade just underneath the lower edge of its tool-receiving aperture through which the anchor cable passes onto the inside thereof. Immediately underneath the dimple, but on the inside of the blade is an integrally-formed downturned ear beneath which the cable is passed preparatory to being crimped in place. The offset of the fulcrum where the cable passes through the aperture in the dimple relative to the upper and lower ends of the blade is such that a vertical pull on the cable following removal of the driving tool will cause its curved section to dig into the ground alongside the hole through which it entered while the straight section raises up and compacts the earth on the other side thus resulting in the blade ending up crosswise of the latter.

10 Claims, 3 Drawing Figures

CABLE ANCHORING DEVICE

Cable anchors of the general type forming the subject matter of the instant invention are well known in the art and form the subject matter of U.S. Pat. Nos. 3,969,854 and 4,044,513 along with 4,096,673 which relates to the method for installing the '513 anchor. These, anchors together with applicant's, all operate upon the principle of driving the anchor into the ground with the cable attached using a suitable driving tool and then tensioning the cable such that the shape of the anchor causes it to assume a crosswise position relative to the hole through which it entered. The prior art anchors mentioned above work quite well; however, both types are expensive, unnecessarily complicated and somewhat difficult to make.

Applicant has found that he can make an anchor which will perform the desired cable-anchoring function just as well, yet, takes the form of a simple stamped part which can be made in a single, or at most two or three, rudimentary operations depending primarily on the type of manufacturing equipment one has available and, perhaps, the type of stock used, i.e. sheet or strap metal. Moreover, the driving tool is equally simple consisting of nothing more than a slotted rod. All knots are eliminated and the cable is fastened to the anchor by merely passing it underneath an integrally-formed ear and crimping the latter down onto the cable. The blade-like anchor is easier to drive into the ground than either a tubular unit or one having a T-shaped cross section.

The anchor and its driving tool cooperate with one another differently than the prior art combinations in that the curved upper section of the anchor is shaped and apertured so as to both receive the slotted end of the tool in substantial axial alignment with its lower end while, at the same time, engaging same at a point laterally offset from its axis spaced well above the slot thus keeping the assembly properly aligned. Also, a dimple on the outside of the anchor cooperates with the ear on the inside thereof to clear a path for the driving tool even though the basic cross section of the anchor is essentially flat and blade-like.

It is, therefore, the principal object of the present invention to provide a novel and improved cable anchor.

A second objective is the provision of a novel combination of anchor and driving tool therefor.

Another object of the within-described invention is that of providing a one-piece stampable anchoring device for anchoring a cable or the like in the ground.

Still another objective of the invention herein disclosed and claimed is to provide an essentially flat blade-like anchor which includes functional projections on both the inside and outside faces thereof that cooperate with one another to prepare a hole for the reception of the driving tool as well as the pointed end of the anchor projecting to one side of the tool.

An additional object is to provide an anchoring device of the character described which includes a bendable integrally-formed ear for fastening the cable thereto that eliminates the need for a knot.

Further objects are to provide a cable anchor which is simple, easy to make and use, inexpensive, versatile, compact, lightweight and even somewhat decorative.

Other objects will be in part apparent and in part pointed out specifically hereinafter in connection with the description of the drawings that follows, and in which.

Figures 1, 2, 3:
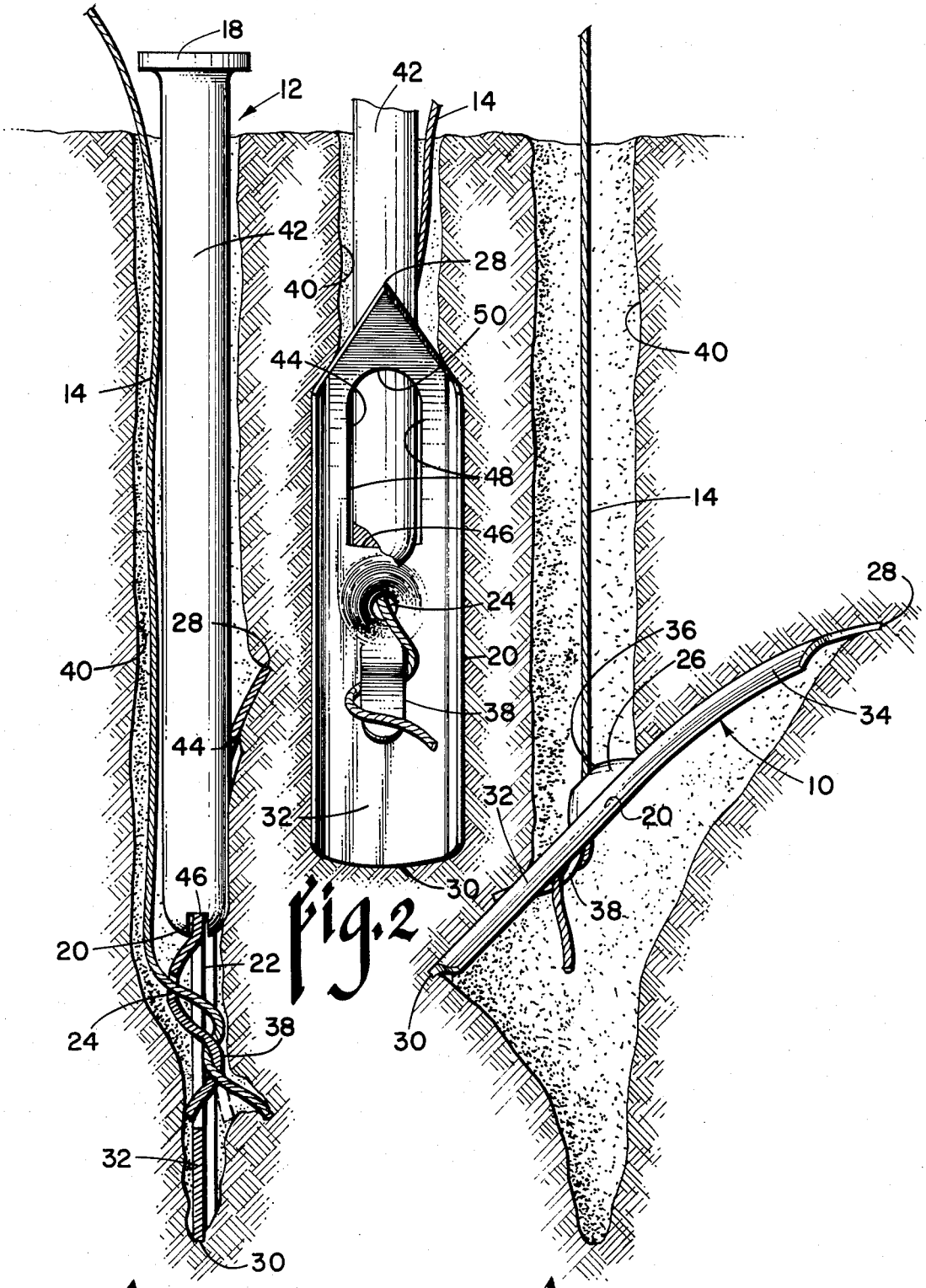
FIG. 1 is a view partly in section and partly in elevation showing the driving tool, anchor and cable being driven into the ground.
FIG. 2 is a fragmentary rear elevational view showing the anchor, driving tool and cable assembly of FIG. 1 and to the same scale as the latter; and, FIG. 3 is a side elevational view to the same scale as FIGS. 1 and 2 showing the driving tool removed and the cable tensioned to pull the anchor into anchoring position crosswise of the entryway.

Referring next to the drawings for a detailed description of the present invention and, initially, to FIGS. 1 and 2 for this purpose, reference numeral 10 has been chosen to broadly identify the cable anchor while numeral 12 similarly identifies the driving tool therefor. Cable 14 in the particular form shown is of the stranded wire type capable of bearing several hundred pound tension loads. Driving tool 12 comprises nothing more than a metal rod, preferably, but not necessarily, cylindrical in cross section, having a slot or kerf 16 in its lower end. As illustrated, the upper end of the tool is provided with an upset head 18 of a construction well known in the art adapted to shield and protect the hand of the user holding the tool while it is being driven into the ground.

Directing the attention next to all three figures of the drawing, anchor 10 will be seen to comprise a blade-like element formed from a flat length of strap metal about four times as long as it is wide. The anchor is shown approximately full size in the drawings although, of course, it can be fabricated in other sizes, both larger and smaller, depending on the load it is to anchor. The side edges are preferably shaped to provide marginal flanges 20 which are bent out of the plane of the main blade 22 at an angle approximating 45°. These flanges are provided for the purpose of stiffening the anchor so that it will be able to resist the substantial bending forces applied by the tensioned cable that tend to fold it along a transverse line passing through the opening 24 where the cable enters dimple 26.

Dimple 26 is formed integral with the blade-like element and is located intermediate its upper and lower ends and midway between the side edges thereof. Upper end 28 is pointed as shown in FIG. 2 while the lower end 30 thereof is essentially blunt although it, too, could be sharpened or otherwise shaped. Except for marginal flanges 20, the section 32 of the blade-like element below the dimple is essentially planar while the section 34 thereabove is curved approximately 25° to 30° as shown most clearly in FIG. 3. For purposes of the present description, the convex face of the anchor member will be referred to as its "front" while the concave side will be designated the "rear" face thereof. With dimple 26 projecting from the front face of the anchor, the top edge of the cable opening 28 therein defines a fulcrum 36 about which it pivots as it moves from the more or less vertically-disposed driven position shown in FIGS. 1 and 2 that it assumes while entering the ground and its crosswise anchored position shown in FIG. 3. For proper operation of the anchor, fulcrum 36 must lie at the apex of a triangle defined by it and upper and lower ends 28 and 30, respectively.

Next, FIGS. 1 and 3 reveal the knotless method for fastening the cable 14 to the anchor. Directly beneath the dimple, but on the rear face of the blade is provided an integrally-formed bendable ear 38 punched in the well known manner out of the blade stock. The cable is threaded through the cable opening 28 from the front and onto the rear face of the blade whereupon it is passed underneath ear 38 while the latter occupies its extended position shown in phantom lines in FIG. 1. It is then secured by crimping the ear down thereagainst as shown in full lines in all three of the drawing figures.

Looking at FIG. 1, it can be seen that the dimple 26 and ear 38 cooperate with one another to widen and shape the hole 40 to receive the driving tool 12 as the essentially planar lower section 32 of the blade is driven into the ground. The pointed end 28 of the blade, of course, further widens the hole 40 to receive the portion of the shank 42 of the driving tool thereabove.

One remaining feature of the anchor has yet to be described and that is the tool-receiving aperture 44 located above the dimple 26 in the curved upper section 34 which is only clearly shown in FIG. 2 to which detailed reference will now be made. The bottom edge 46 of this tool-receiving opening is essentially horizontal and defines the surface which fits up into the kerf 20 in the driving tool. The side edges 48 of this same opening 44 are spaced apart a distance just slightly greater than the width of the driving tool measured in the direction of the kerf, i.e. the diameter of the tool in the case of a cylindrically-shanked one. The upper edge 50 of aperture 44 is shaped and positioned to receive and retain the shank 42 of the driving tool such that the axis thereof is aligned with the planar section 32 of the anchor extending therebeneath. With the shank of the driving tool thus seated within the aperture 44 in the upper curved section 34 of the blade, it becomes a simple matter to drive the latter straight down into the ground as shown in FIG. 1. The projecting sharpened end 28 on the upper end of the blade, of course, digs into the wall of the hole 40 alongside thereof which engagement tends to rotate the blade counterclockwise as viewed in FIG. 1 while it is being driven thus holding it securely against the shank of the driving tool.

Finally with reference to FIG. 3, it can be seen that once the anchor 10 is at the preselected depth and the driving tool removed, it only remains to tension the cable 14 and raise the anchor upwardly, whereupon, the curved section 34 will dig into the wall alongside the hole on one side and the straight section 32 will do likewise on the other until it assumes a crosswise position at an angle approximating 45° to the vertical. The aforementioned anchoring action is, of course, not novel in that the previously-mentioned cable anchors operate in the same way.

What is claimed is:

1. A cable anchor which comprises: an elongate rigid blade-like member having upper and lower ends, a curved section extending at least from a point intermediate the ends thereof to its upper end defining a concave inner face and a convex outer face, an integrally-formed dimple located intermediate the upper and lower ends of said member projecting from its outer face, a downwardly-opening integrally-formed bendable ear disposed beneath the dimple and projecting from the inner face of said member, and a cable opening in the dimple for passing a cable from the outer face of said member onto the inner face thereof into position to be crimped and secured between the said inner face and the ear, a portion of said dimple bordering the top of said cable opening defining a fulcrum located at the apex of an angle formed by the said fulcrum and the upper and lower ends, and said curved section being operative upon insertion of the blade member lower end first into the ground in an essentially upright position to coaperating with said fulcrum and defining means effective to lift and rotate said member into a crosswise position when said cable is tensioned thus anchoring the assembly in the hole produced when it in inserted.

2. The cable anchor as set forth in claim 1 in which: the upper end is shaped forming a point.

3. The cable anchor as set forth in claim 1 in which: the blade member includes an essentially planar portion adjacent its lower end.

4. The cable anchor as set forth in claim 1 in which: the blade member includes side edges, and in which at least one of said side edges is bordered by a marginal flange inclined at an angle relative thereto effective resisting bending of the blade upon tensioning of the cable.

5. The cable anchor as set forth in claim 1 in which: the curved section is provided with a tool-receiving opening, said opening having a lower edge shaped to receive and releaseably retain the lower end of an elongate driving tool, said opening having side edges spaced and shaped to receive and confine the sides of the tool, and said opening having an upper edge spaced above and to one side of its lower edge a distance effective to engage and maintain the tool in substantial axial alignment with the portion of the blade member projecting therebeneath.

6. The cable anchor as set forth in claim 4 in which: the side edges are substantially parallel to one another and both are bordered by marginal flanges.

7. The cable anchor as set forth in claim 5 in which: the portion of the blade member beneath the lower edge of the tool-receiving opening is essentially planar and adapted to cooperate with the driving tool when seated in said opening to guide said member in straightline relation to the latter.

8. The cable anchor as set forth in claim 5 in which: the lower edge of the tool-receiving opening is shaped to receive and releaseably retain the lower end of a slotted driving tool.

9. The cable anchor as set forth in claim 5 in which: the upper edge of the tool-receiving opening is offset to one side of the lower edge thereto a distance amounting to approximately one-half the thickness of an elongate driving tool of substantially uniform thickness.

10. The cable anchor as set forth in claim 5 in which: the lower edge of the tool-receiving opening is shaped to receive and releaseably retain the lower end of a diametrically-slotted substantially cylindrical driving tool, and in which the upper edge of the tool-receiving opening is offset to one side of the lower edge thereof a distance amounting to approximately the radius of said driving tool.

* * * * *